US008816929B2

(12) United States Patent
Kam et al.

(10) Patent No.: US 8,816,929 B2
(45) Date of Patent: Aug. 26, 2014

(54) ANTENNA ARRAY PACKAGE AND METHOD FOR BUILDING LARGE ARRAYS

(75) Inventors: Dong G. Kam, White Plains, NY (US); Duixian Liu, Scarsdale, NY (US); Scott K. Reynolds, Amawalk, NY (US)

(73) Assignee: International Business Machines Corporation, Armonk, NY (US)

( * ) Notice: Subject to any disclaimer, the term of this patent is extended or adjusted under 35 U.S.C. 154(b) by 602 days.

(21) Appl. No.: 13/191,917

(22) Filed: Jul. 27, 2011

(65) Prior Publication Data

US 2013/0027271 A1 Jan. 31, 2013

(51) Int. Cl.
*H01Q 1/48* (2006.01)
*H01Q 1/38* (2006.01)

(52) U.S. Cl.
USPC ..... 343/848; 343/700 MS; 343/846; 343/829; 343/841; 29/600

(58) Field of Classification Search
None
See application file for complete search history.

(56) References Cited

U.S. PATENT DOCUMENTS

| | | | | |
|---|---|---|---|---|
| 5,977,924 | A * | 11/1999 | Takei et al. | 343/770 |
| 6,774,848 | B2 | 8/2004 | Wright | 343/700 MS |
| 6,812,893 | B2 | 11/2004 | Waterman | 343/700 MS |
| 6,828,938 | B2 | 12/2004 | Tran | 343/700 MS |
| 6,876,336 | B2 | 4/2005 | Croswell et al. | 343/795 |
| 6,917,332 | B2 | 7/2005 | Aikawa et al. | 343/700 MS |
| 7,167,129 | B1 | 1/2007 | Strassner, II | 343/700 MS |
| 7,221,322 | B1 | 5/2007 | Durham et al. | 343/700 MS |
| 7,811,854 | B2 | 10/2010 | Gabara | 438/107 |
| 7,994,998 | B2 * | 8/2011 | Engel | 343/772 |
| 2004/0155819 | A1 | 8/2004 | Martin et al. | 343/700 MS |
| 2004/0239567 | A1 * | 12/2004 | Van Der Poel | 343/700 MS |
| 2008/0143623 | A1 | 6/2008 | Pintos et al. | 343/767 |
| 2008/0258993 | A1 * | 10/2008 | Gummalla et al. | 343/876 |
| 2009/0146890 | A1 | 6/2009 | Gabara | 343/745 |

* cited by examiner

*Primary Examiner* — Trinh Dinh
(74) *Attorney, Agent, or Firm* — Ido Tuchman; Anne V. Dougherty

(57) ABSTRACT

Array packages and methods for forming large-scale antenna arrays. One method includes aligning two or more array packages. The two or more array packages each include one or more bottom dielectric layers, an array of antennas arranged in a plane above the one or more bottom dielectric layers, a ground plane layer above the one or more bottom dielectric layers, and a conductive surface on at least a part of an outside surface of the array package and orthogonal to the plane of the array of antennas. The conductive surface is electrically connected to the ground plane layer.

25 Claims, 9 Drawing Sheets

ANTENNA ARRAY PACKAGE AND METHOD FOR BUILDING LARGE ARRAYS

BACKGROUND

The present invention is directed towards the forming of antenna arrays, and more particularly to the use of antenna array packages to form large-scale antenna arrays.

Antenna arrays are used in a variety of applications. One application is the use of antenna arrays to create a phased-array. Phased-array radar or imaging systems typically include a large number of planar antenna elements ranging from several hundreds to thousands. An example of a phased-array imaging system is a millimeter wave imaging system. Millimeter wave imaging, in some cases, involves passive detection of naturally occurring radiation in the millimeter wave (30 GHz to 300 GHz) band. Atmospheric propagation windows for millimeter wave radiation (in which there is minimal atmospheric absorption of the radiation) exist at 35, 94, 140, and 220 GHz. Thus, many millimeter wave imagers are designed to operate at these frequencies. However, imagers are also designed to operate at other frequencies, particularly in cases where detection of radiation is required only over relatively short distances (e.g., 10 m).

BRIEF SUMMARY

An example embodiment of the present invention is an array package for forming large-scale antenna arrays. The array package includes one or more bottom dielectric layers, an array of antennas arranged in a plane above the one or more bottom dielectric layers, a ground plane layer above the one or more bottom dielectric layers, and a conductive surface electrically connected to the ground plane layer. The ground plane layer is electrically conductive. The conductive surface is carried by at least a part of an outside surface of the array package and orthogonal to the plane of the array of antennas.

Another example embodiment of the present invention is an antenna system comprising two or more array packages electrically coupled together. Each of the array packages includes one or more bottom dielectric layers, an array of antennas arranged in a plane above the one or more bottom dielectric layers, a ground plane layer above the one or more bottom dielectric layers, and a conductive surface. The ground plane layer is electrically conductive. The conductive surface is carried by at least a part of an outside surface of the array package and orthogonal to the plane of the array of antennas. The conductive surface is electrically connected to the ground plane layer.

Another example embodiment of the invention is a method for forming an antenna array package. The method includes forming one or more bottom dielectric layers, forming an array of antennas arranged in a plane above the one or more bottom dielectric layers, forming a ground plane layer above the one or more bottom dielectric layers, and forming a conductive surface carried by at least a part of an outside surface of the array package. The ground plane layer is electrically conductive. The conductive surface is electrically connected to the ground plane layer and orthogonal to the plane of the array of antennas.

Yet another example embodiment of the invention is a method for forming large-scale antenna arrays. The method includes aligning two or more array packages. The array packages each include one or more bottom dielectric layers, an array of antennas arranged in a plane above the one or more bottom dielectric layers, a ground plane layer above the one or more bottom dielectric layers, and a conductive surface. The ground plane layer is electrically conductive. The conductive surface is carried by at least a part of an outside surface of the array package and orthogonal to the plane of the array of antennas. The conductive surface is electrically connected to the ground plane layer.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

The present invention is described with reference to embodiments of the invention. Throughout the description of the invention reference is made to FIGS. 1-6. As discussed in detail below, embodiments of the present invention include antenna array packages and a method for forming large-scale antenna arrays as well as a method for forming an the antenna array packages.

Figure 1:
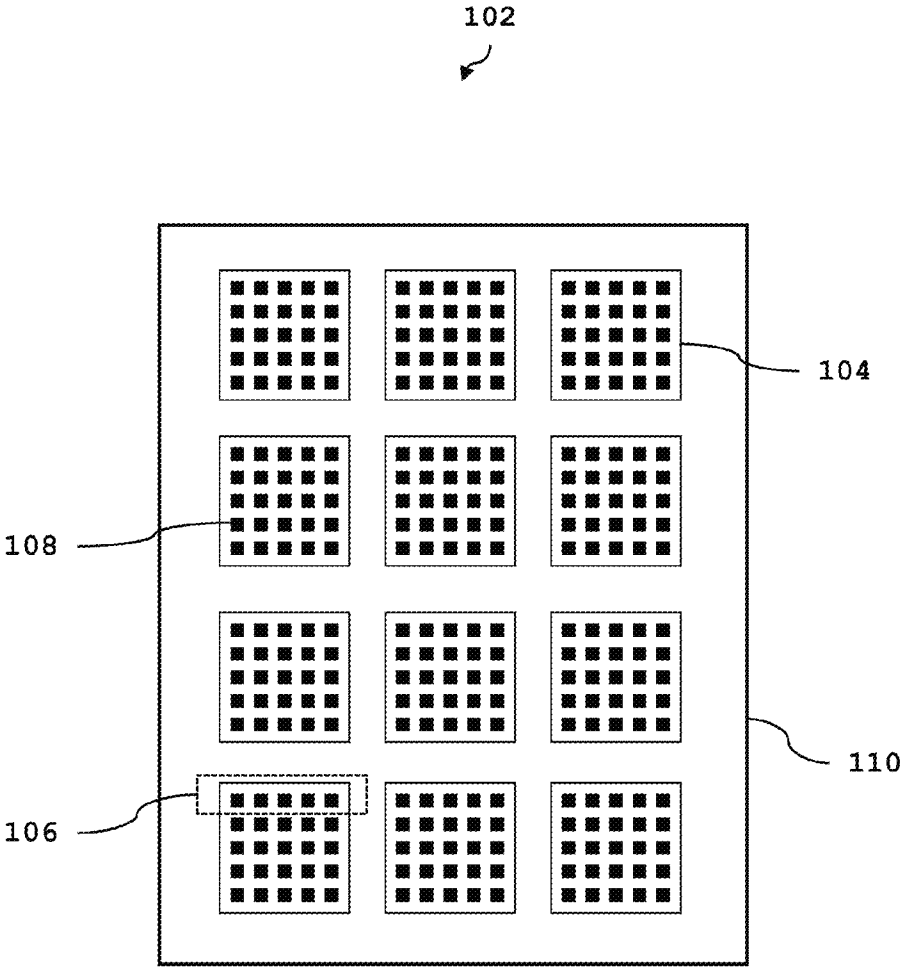
FIG. 1 shows a top-down view of an example embodiment of a large-scale antenna array in accordance with the present invention.

FIG. 1 shows a top-down view of a large-scale antenna array 102 in accordance with the present invention. The large-scale antenna array 102 may be a phased antenna array. In one embodiment, the large-scale antenna array 102 includes a plurality of array packages 104. Each array package 104 may include an array 106 of antennas 108 configured as one or more sub-arrays in the large-scale antenna array 102. Each sub-array may be built in a package smaller than the large-scale antenna array 102 to be assembled at the board level with the other sub-arrays included in the plurality of array packages 104. In one embodiment, the one or more array packages are fixed to a printed circuit board 110.

In one embodiment, the array packages 104 are configured to receive waves at the millimeter wave frequency band. The array packages 104 may be fabricated in low-temperature co-fired ceramic (LTCC) technology. In another embodiment, the array packages 104 may be manufactured as printed circuit boards smaller than the printed circuit board 110 of the large-scale antenna array 102, and thus, the smaller printed circuit boards may be fabricated using conventional printed circuit board manufacturing technology. Indeed, the package substrate can be made of other materials, and embodiments of the invention are not limited to any particular package types. The array packages 104 are described in further detail below.

Figure 2:
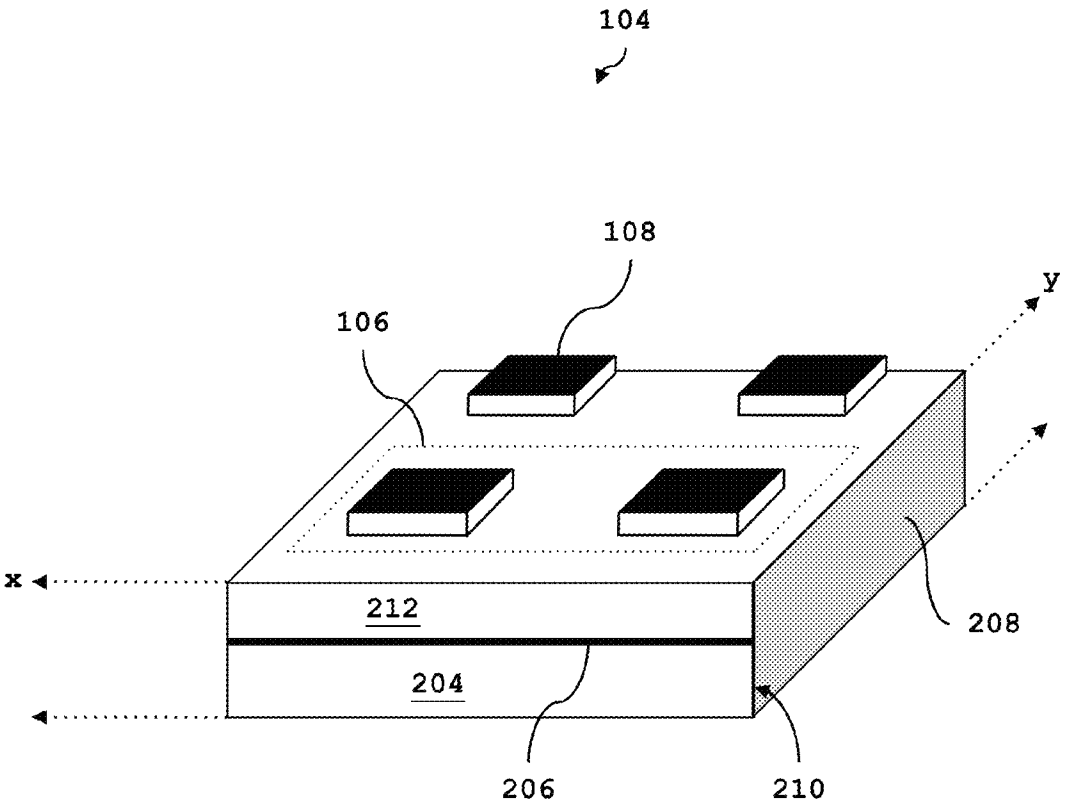
FIG. 2 shows a three dimensional cross-sectional view of an example embodiment of an array package for forming large-scale antenna arrays.
Figure 3:
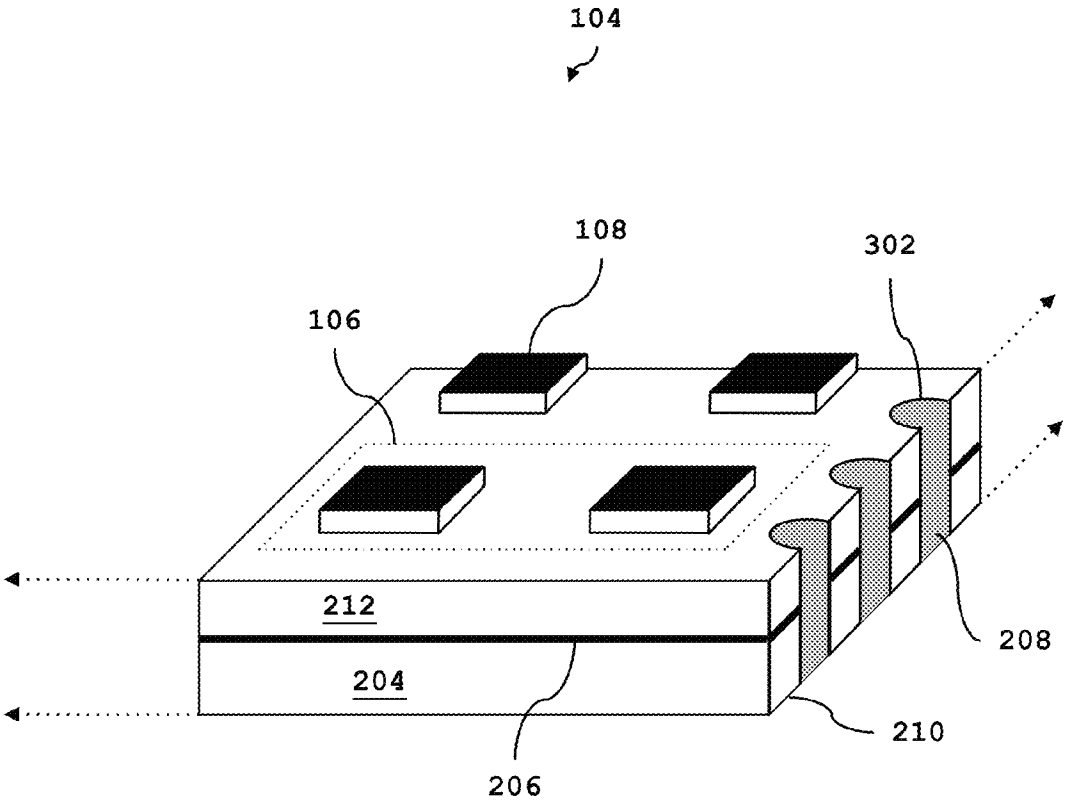
FIG. 3 shows a three dimensional cross-sectional view of an example embodiment of an array package with a plurality of vias.

FIG. 2 shows a cross-sectional view of an example embodiment of an array package 104 for forming large-scale antenna arrays. Dotted arrows indicate that the array package 104 may extend out further in the x and y directions than shown in FIG. 2. The array package 104 may include one or more bottom dielectric layers 204. The array package 104 may include an array 106 of antennas 108 arranged in a plane above the one or more bottom dielectric layers 204. In one embodiment, the array package 104 includes a ground plane layer 206 above the one or more bottom dielectric layers 204. The ground plane layer 206 may be electrically conductive.

The array package 104 may include a conductive surface 208 carried by at least a part of an outside surface 210 of the array package 104 and orthogonal to the plane of the array 106 of antennas 108. The conductive surface 208 may be electrically connected to the ground plane layer 206. For example, the ground plane layer 206 may have an outer edge that is part of the outside surface 210 of the array package 104. The ground plane layer 206 may abut the conductive surface 208 and form an electrical connection with the conductive surface 208. In one embodiment, the array package includes one or more top dielectric layers 212 above the ground plane layer 206. The conductive surface 208 may be carried by a layer from the one or more top dielectric layers 212 and/or a layer from the one or more bottom dielectric layers 204. In some embodiments, the array package 104 is fabricated by multiple sub-laminations. In this case, the conductive surface 208 may be formed on and/or carried by only one or some of the sub-laminate layers.

In one embodiment, the conductive surface 208 of the array package 104 is a conductive plate carried by the outside surface 210 of the array package 104. In another embodiment, shown in FIG. 3, the conductive surface 208 of the array package 104 is a cross-section of one or more plated vias 302. The plated vias 302 may each be a groove on the outside surface 210 of the array package 104. The groove may be plated with a conductive material. In one embodiment, each cross-section of the plated vias 302 includes the inner surface of the via. In one embodiment, each cross-section of the one or more plated vias 302 includes a surface revealed after removing a portion of the via. Though not shown, the array package 104 may include conductive lines and other useful features associated with different embodiments of the invention. In some embodiments, additional dielectric layers may be present above and below the ground plane layer 206 and/or array 106 of antennas 108.

Figure 4:
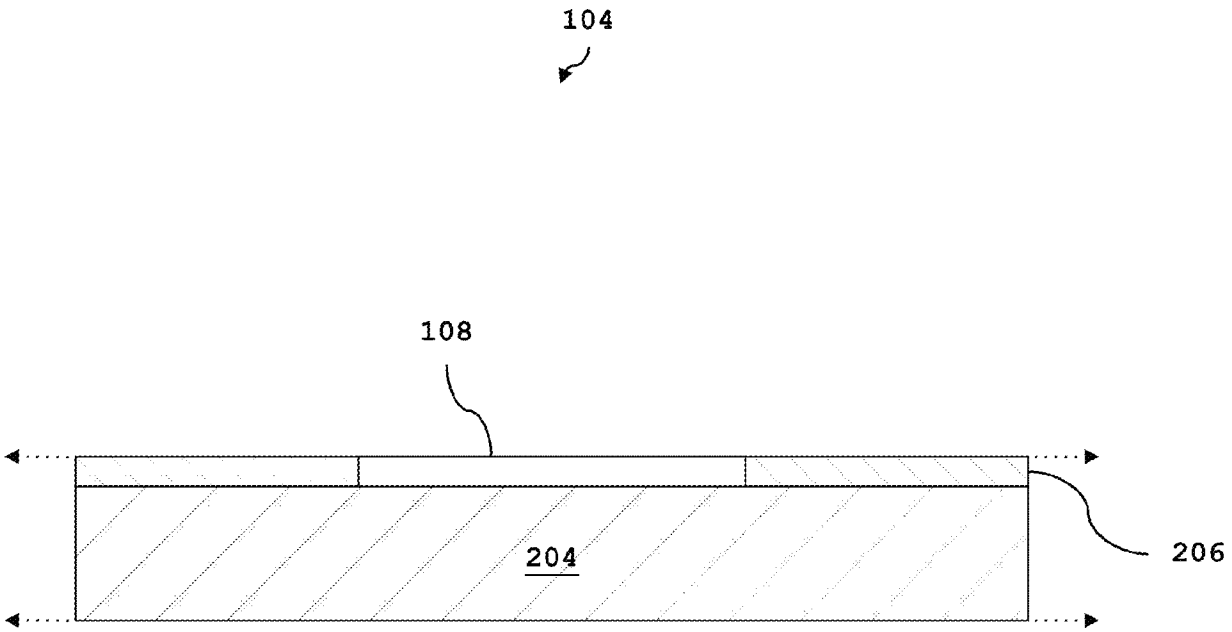
FIG. 4 shows a cross-sectional view of an example array package with a slot antenna.
Figure 5:
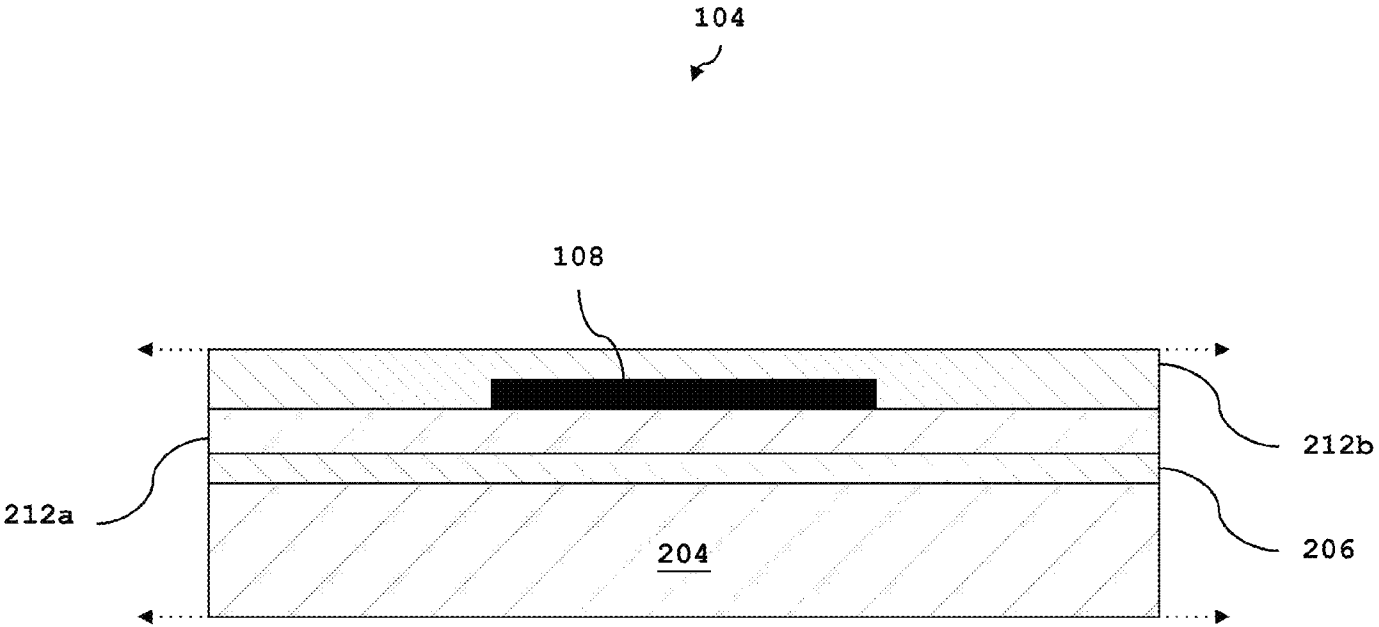
FIG. 5 shows a cross-sectional view of an example array package with two top dielectric layers and a patch antenna.
Figure 6:
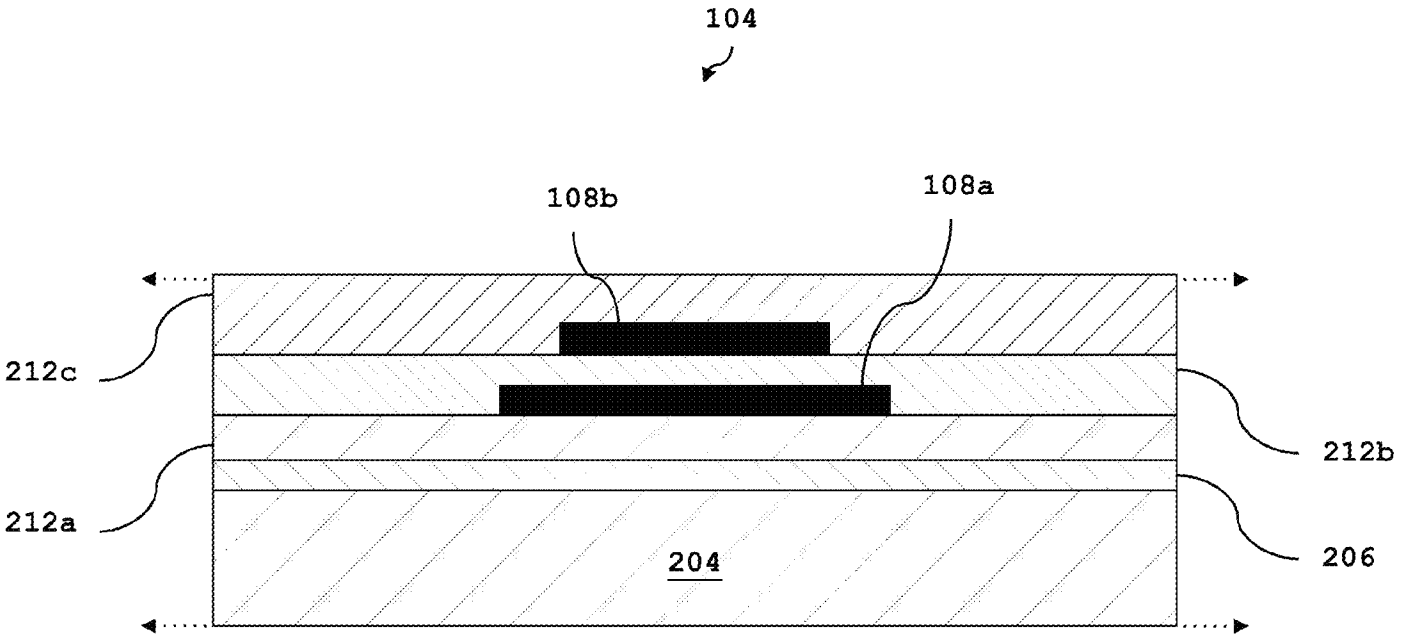
FIG. 6 shows a cross-sectional view of an example array package with stack antennas.

FIGS. 4-6 show various embodiments of the array package 104 using different types of antennas 108, and it is noted that, though not necessarily described below, these embodiments may include the features of array package 104 described above. For example, though the conductive surface 208 is not shown, it is understood that each of the embodiments of the array package 104 includes the conductive surface 208 described above. Additionally, FIGS. 4-7 may show only partial views of the array package, and the antennas 108 of each embodiment may be part of the array 106 of antennas 108 described above.

FIG. 4 shows a cross-sectional view of an example array package 104. The antenna 108 of array package 104 may be a slot antenna. In one embodiment, the slot antenna 108 is part of the array of antennas 108 and is arranged in a plane in the ground plane layer 206. Each slot antenna 108 in the array may be a separate hole in the ground plane layer 206. The ground plane layer 206 may be above the one or more bottom dielectric layers 204. Though slot antenna 108 is shown as a hole in the ground plane layer 206, it is understood that the ground plane layer 206 may be otherwise continuous from a view not taken through a cross-section of the hole.

FIG. 5 shows a cross-sectional view of an example array package 104 with two top dielectric layers 212*a* and 212*b*. In one embodiment, the antenna 108 is a patch antenna. Top dielectric layer 212*b* may cover the antenna 108.

FIG. 6 shows a cross-sectional view of an example array package 104 with antennas 108*a* and 108*b*. Antennas 108*a* and 108*b* may be stack antennas with antenna 108*b* above antenna 108*a*. The array package 104 may include three top dielectric layers 212*a*, 212*b*, and 212*c* above the ground plane layer 206. In another embodiment, top dielectric layer 212*c* is not included.

Figure 7:
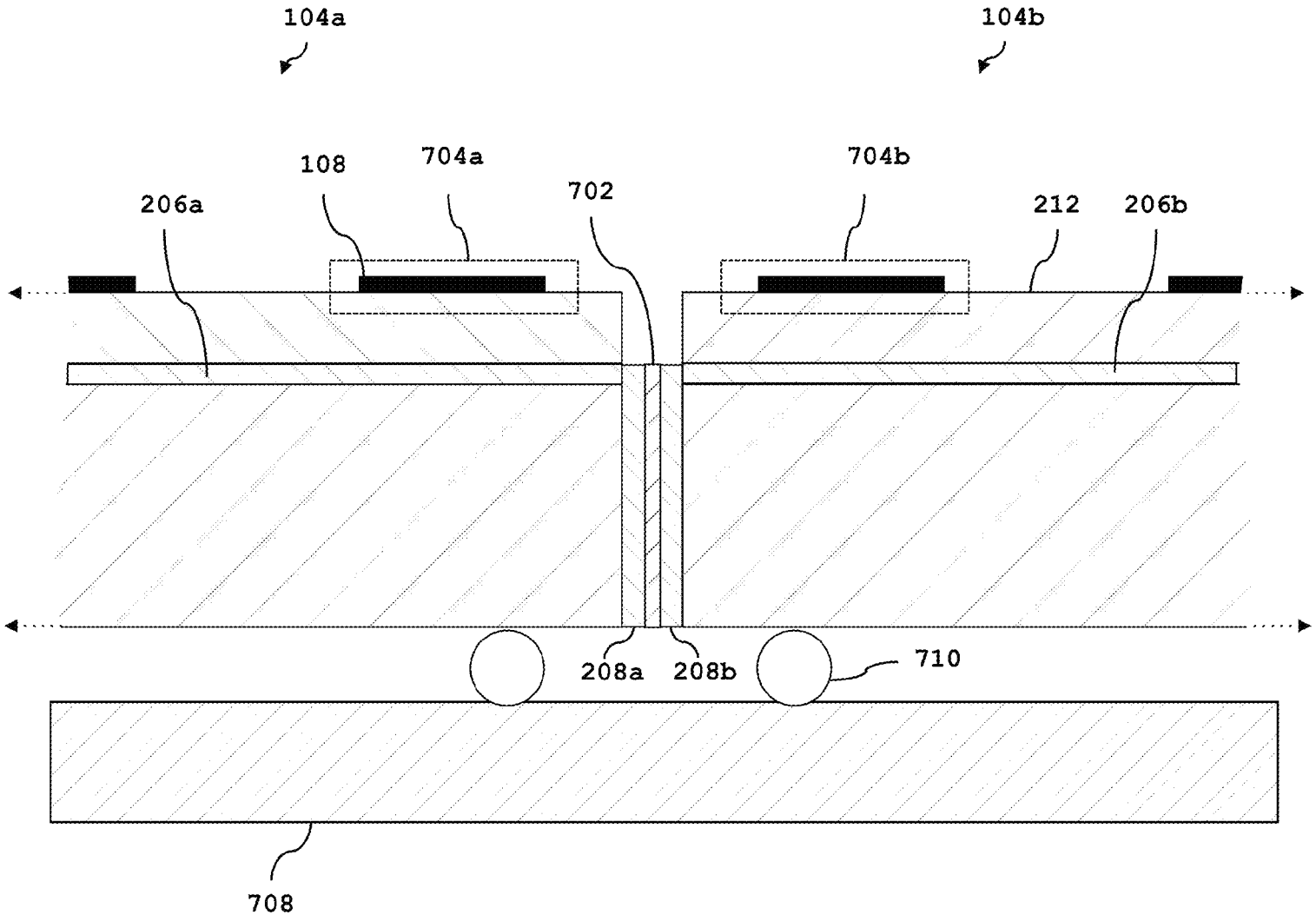
FIG. 7 shows a cross-sectional view of an example embodiment of two array packages for forming large-scale antenna arrays.

FIG. 7 shows a cross-sectional view of an example embodiment of two array packages 104*a* and 104*b* for forming large-scale antenna arrays. The two array packages 104*a* and 104*b* may each be an embodiment of the array package 104 described above. The conductive surface 208*a* of each array package 104*a* may be united with a conductive surface 208*b* of at least one other array package 104*b*. The conductive surfaces 208*a* and 208*b* may be united such that the ground plane layers 206*a* and 206*b* from the respective array packages form a united ground plane layer electrically continuous in one plane. In one embodiment, the conductive surfaces 208*a* and 208*b* are configured so that electric charge may travel between the ground plane layers 206*a* and 206*b* without traveling through a printed circuit board 408 on which the array packages 104*a* and 104*b* are mounted. In an embodiment where the conductive surfaces 208*a* and 208*b* are plated vias, physical holes may be present in the united ground plane layer, but electric charge may still flow in substantially the same plane by following electrical paths in the plane of ground plane layers 206*a* and 206*b* rather than electrical paths that include the printed circuit board 408. The conductive surfaces 208*a* and 208*b* of the two or more array packages 104*a* and 104*b* may be united by eutectic solder 702. The eutectic solder is additionally described below.

In one embodiment, the array of antennas of each array package 104*a* and 104*b* includes a set of antennas 704*a* and 704*b* closest to the conductive surface. The set of antennas 704*a* of each array package 104*a* may be separated from a different set of antennas 704*b* from a different array package 104*b* by a distance of at most one wavelength that the array package is configured to receive. In a phased array, the spacing between elements in the x-direction and y-direction may be less than the wavelength to avoid grating lobes in the x-z and y-z planes. In one embodiment, the separation between the antennas may be designed to be around half the wavelength. For example, in a 94-GHz imaging system, the separation may be around 1.6 mm by assuming free space.

In one embodiment, the separation of each set of antennas 704*a* from the different set of antennas 704*b* is measured to and from the center the antennas. The separation between two antennas that are implemented in different packages may be the same as the separation between two antennas in a single package. The set of antennas 704*a* and 704*b* closest to the conductive surface may be placed very close to the package edge (less than a quarter wavelength in this case).

In one embodiment, the two or more array packages 104*a* and 104*b* are fixed to a printed circuit board 708. The two or more array packages 104*a* and 104*b* may be fixed to the printed circuit board 708 using balls 710 of solder in a ball grid array. Ball grid array (BGA) technology is shown here as an example but any other assembly technologies can be used instead. In one embodiment, eutectic solder is used to fix the array packages 104*a* and 104*b* to the printed circuit board 708. In another embodiment, lead-free solder is used to fix the array packages 104*a* and 104*b* to the printed circuit board 708. In addition to eutectic or lead-free solder, high-lead (e.g., 97Pb/3Sn) solder may also be used for balls 710. The solder is additionally described below.

Figure 8:
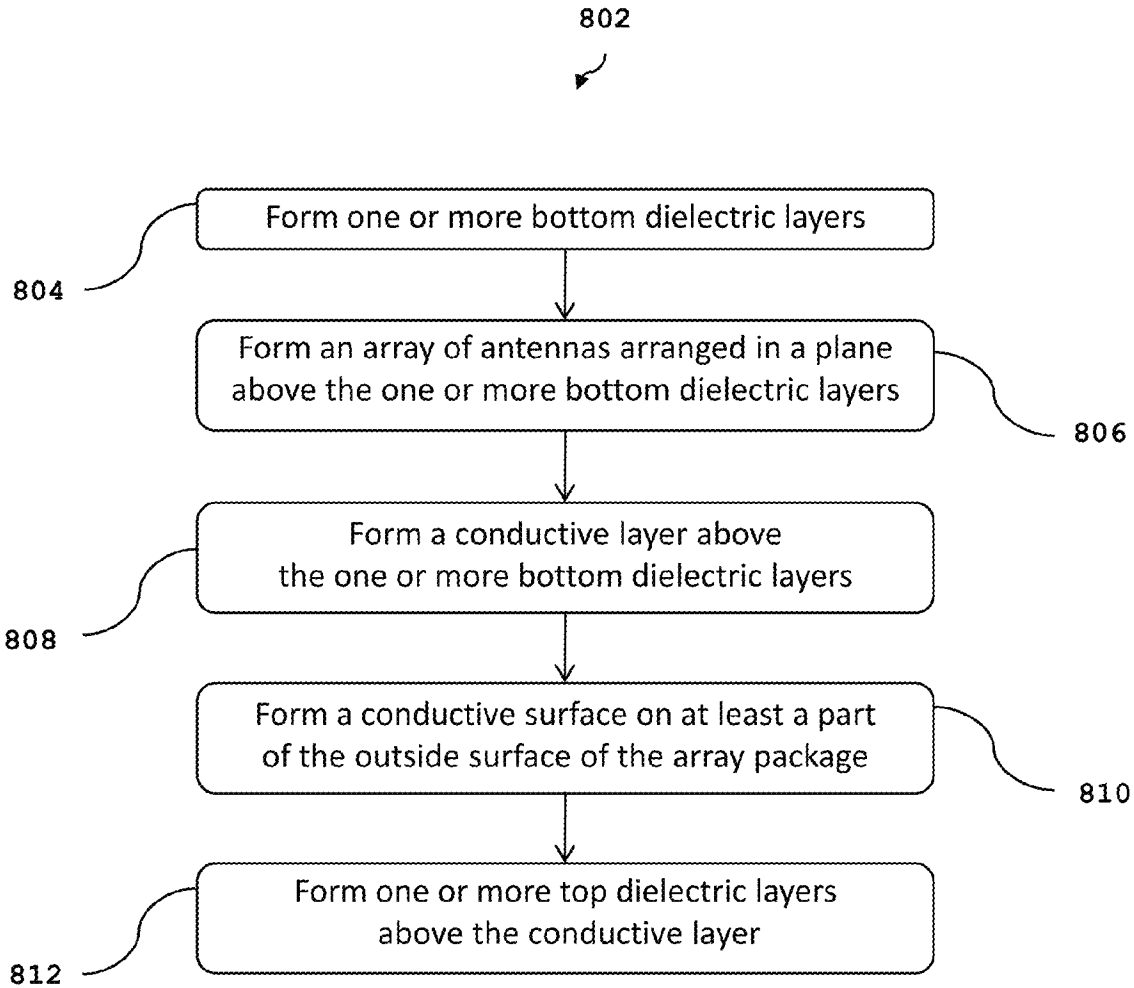
FIG. 8 shows an example embodiment of a method for forming an antenna array package.

FIG. 8 shows an example embodiment of a method 802 for forming an antenna array package contemplated by the present invention. In one embodiment, the method 802 includes a bottom dielectric forming step 804 of forming one or more bottom dielectric layers. The method 802 may include an antenna array forming step 806 of forming an array of antennas arranged in a plane above the one or more bottom dielectric layers. The method 802 may include a ground plane layer forming step 808 of forming a ground plane layer above the one or more bottom dielectric layers. The ground plane layer may be electrically conductive.

In one embodiment, the method 802 includes a conductive surface forming step 810 of forming a conductive surface carried by at least a part of an outside surface of the array package. The conductive surface may be electrically connected to the ground plane layer and orthogonal to the plane of the array of antennas. In one embodiment, the conductive surface is a conductive plate carried by the outside surface of the array package. In another embodiment, the conductive surface is a cross-section of one or more plated vias. The plated vias may each be a groove on the outside surface of the array package, and each groove may be plated with a conductive material. The conductive surface is described in greater detail above.

In one embodiment, the method 802 includes a top dielectric forming step 812 of forming one or more top dielectric layers above the ground plane layer. The conductive surface may be carried by a layer from the one or more top dielectric layers and/or a layer from the one or more bottom dielectric layer. In one embodiment, the array package is formed through multiple sub-laminations, and each layer from the one or more top dielectric layers and each layer from the at least one bottom dielectric layer are different sub-laminates.

Figure 9:
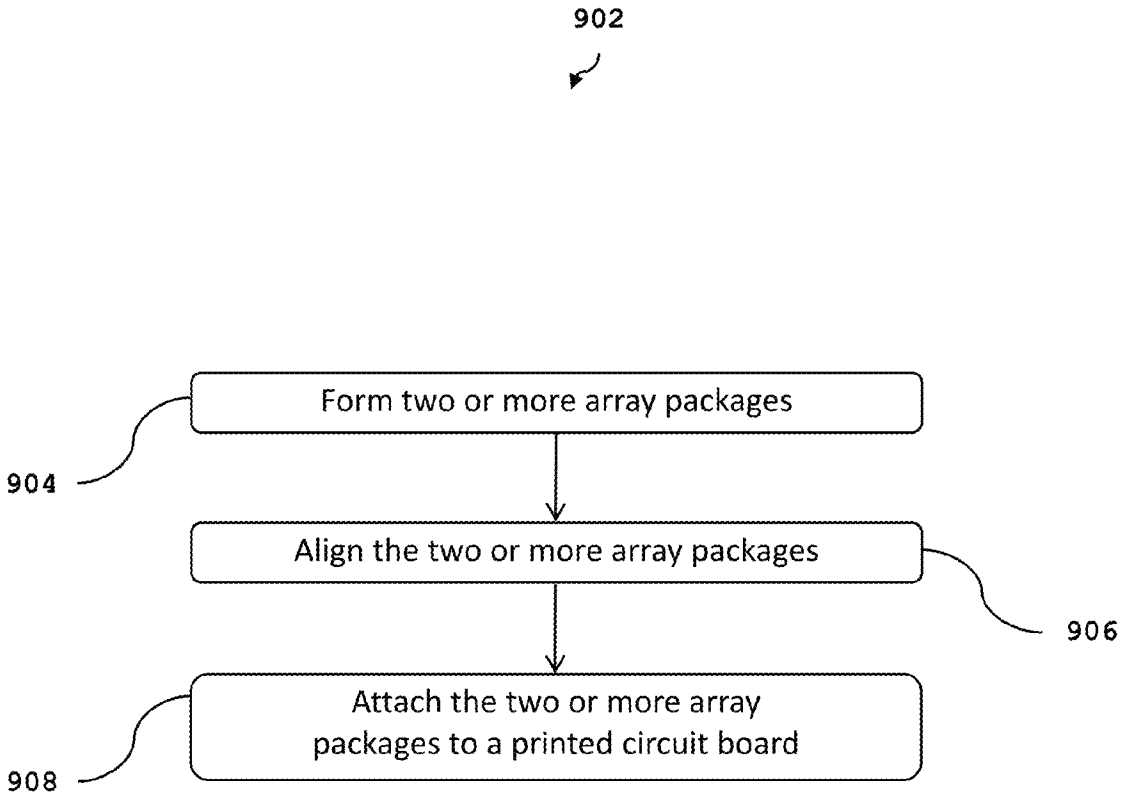
FIG. 9 shows an example embodiment of a method for forming large-scale antenna arrays.

FIG. 9 shows an example embodiment method 902 for forming large-scale antenna arrays. In one embodiment, the method 902 includes an array package forming step 904 of forming two or more array packages. Embodiments of the array packages are described in detail above. For example, method 802 may be employed to manufacture each of the two or more array packages. In another embodiment, the two or more array packages (described above) are already formed, and thus, method 902 may not include the package forming step 904 in such embodiment. The method 902 may include an aligning step 906 of aligning two or more array packages. In one embodiment, aligning the two or more array packages is performed by uniting a conductive surface on an array package with a conductive surface of another array package. The conductive surfaces may be united such that the ground plane layers from the respective array packages form a united ground plane layer electrically continuous in one plane. In one embodiment, uniting the conductive surfaces of the two or more array packages includes applying eutectic solder between the conductive surfaces of the two or more array packages. In one embodiment, the eutectic solder includes sixty-three percent tin and thirty-seven percent lead.

In one embodiment, the array of antennas of each array package includes a set of antennas closest to the conductive surface. The two or more array packages may be aligned such that the set of antennas of each array package is separated from a different set of antennas from a different array package by a distance of at most a wavelength the array package is configured to receive. The set of antennas closest to the conductive surface is described in greater detail above.

The method 902 may include an attaching step 908 of attaching the two or more array packages to a printed circuit board. In one embodiment, the aligning step 906 and the attaching step 908 are performed at the same time. Performing these steps at the same time may be accomplished, for example, by applying eutectic solder both between the conductive surfaces of the two or more array packages and between the printed circuit board and each array package. In another embodiment, the attaching step 908 may occur after the aligning step 906. Eutectic solder may be used, for example, when the array packages are fixed to a printed circuit board in attaching step 908 before the aligning step 906. A different solder may be used to fix the array packages to the circuit board. The eutectic solder may have a lower melting point than the different solder used to fix the array packages to the printed circuit board. In one embodiment the eutectic solder includes lead and the different solder does not include lead.

While the preferred embodiments to the invention have been described, it will be understood that those skilled in the art, both now and in the future, may make various improvements and enhancements that fall within the scope of the claims which follow. These claims should be construed to maintain the proper protection for the invention first described.

What is claimed is:

1. An array package for forming antenna arrays, the array package comprising:

at least one bottom dielectric layer;

an array of antennas arranged in a plane above the at least one bottom dielectric layer;

a ground plane layer above the at least one bottom dielectric layer, the ground plane layer being electrically conductive; and a conductive surface electrically connected to the ground plane layer, the conductive surface being carried by at least a part of an outside surface of the array package and orthogonal to the plane of the array of antennas.

2. The array package of claim 1, wherein the conductive surface is a conductive plate carried by the outside surface of the array package.

3. The array package of claim 1, wherein the conductive surface is a cross-section of at least one plated via, the at least one plated via being a groove on the outside surface of the array package, the groove being plated with a conductive material.

4. The array package of claim 1, further comprising:

at least one top dielectric layer above the ground plane layer, wherein the conductive surface is carried by one of a layer from the at least one top dielectric layer and a layer from the at least one bottom dielectric layer.

5. An antenna system comprising:

at least two array packages electrically coupled together, each of the array packages comprising:

at least one bottom dielectric layer;

an array of antennas arranged in a plane above the at least one bottom dielectric layer;

a ground plane layer above the at least one bottom dielectric layer, the ground plane layer being electrically conductive; and a conductive surface carried by at least a part of an outside surface of the array package and orthogonal to the plane of the array of antennas, the conductive surface electrically connected to the ground plane layer.

6. The antenna system of claim 5, wherein the conductive surface of each array package is united with a conductive surface of at least one other array package such that the ground plane layers from the respective array packages form a united ground plane layer electrically continuous in one plane.

7. The antenna system of claim 5, wherein the conductive surface of each array package is a conductive plate carried by the outside surface of the array package.

8. The antenna system of claim 5, wherein the conductive surface of each array package is a cross-section of at least one plated via, the at least one plated via being a groove on the outside surface of the array package, the groove being plated with a conductive material.

9. The antenna system of claim 5, each array package further comprising:

at least one top dielectric layer above the ground plane layer, wherein the conductive surface is carried by one of a layer from the at least one top dielectric layer and a layer from the at least one bottom dielectric layer.

10. The antenna system of claim 5, wherein the conductive surfaces of the at least two array packages are united by eutectic solder.

11. The antenna system of claim 5, wherein the array of antennas of each array package includes a set of antennas closest to the conductive surface, the set of antennas of each array package being separated from a different set of antennas from a different array package by a distance of at most a wavelength the array package is configured to receive.

12. The antenna system of claim 5, further comprising:

a printed circuit board, wherein the at least two array packages are fixed to the printed circuit board.

13. A method for forming an antenna array package, the method comprising:

forming at least one bottom dielectric layer;

forming an array of antennas arranged in a plane above the at least one bottom dielectric layer;

forming a ground plane layer above the at least one bottom dielectric layer, the ground plane layer being electrically conductive; and forming a conductive surface carried by at least a part of an outside surface of the array package, the conductive surface electrically connected to the ground plane layer and orthogonal to the plane of the array of antennas.

14. The method of claim 13, wherein the conductive surface is a conductive plate carried by the outside surface of the array package.

15. The method of claim 13, wherein the conductive surface is a cross-section of at least one plated via, the at least one plated via being a groove on the outside surface of the array package, the groove being plated with a conductive material.

16. The method claim 13, further comprising:

forming at least one top dielectric layer above the ground plane layer, wherein the conductive surface is carried by one of a layer from the at least one top dielectric layer and a layer from the at least one bottom dielectric layer.

17. A method for forming antenna arrays, the method comprising:

aligning at least two array packages, the array packages each including: at least one bottom dielectric layer, an array of antennas arranged in a plane above the at least one bottom dielectric layer, a ground plane layer above the at least one bottom dielectric layer, and a conductive surface carried by at least a part of an outside surface of the array package and orthogonal to the plane of the array of antennas, the ground plane layer being electrically conductive and the conductive surface electrically connected to the ground plane layer.

18. The method of claim 17, wherein aligning the at least two array packages is performed by uniting a conductive surface on an array package with a conductive surface of another array package such that the ground plane layers from the respective array packages form a united ground plane layer electrically continuous in one plane.

19. The method of claim 17, wherein uniting the conductive surfaces of the at least two array packages includes applying eutectic solder between the conductive surfaces of the at least two array packages.

20. The method of claim 17, wherein the array of antennas of each array package includes a set of antennas closest to the conductive surface, wherein the at least two array packages are aligned such that the set of antennas of each array package is separated from a different set of antennas from a different array package by a distance of at most a wavelength the array package is configured to receive.

21. The method of claim 17, further comprising:

attaching the at least two array packages to a printed circuit board.

22. The method of claim 17, wherein attaching the at least two array packages to a printed circuit board and aligning the at least two array packages is performed at the same time.

23. The method of claim 17, wherein the conductive surface is a conductive plate carried by the outside surface of the array package.

24. The method of claim 17, wherein the conductive surface is a cross-section of at least one plated via, the at least one plated via being a groove on the outside surface of the array package, the groove being plated with a conductive material.

25. The method claim 17, wherein each array package further includes:

at least one top dielectric layer above the ground plane layer, wherein the conductive surface is carried by one of a layer from the at least one top dielectric layer and a layer from the at least one bottom dielectric layer.

* * * * *